US005502988A

United States Patent [19]

Shimazaki et al.

[11] Patent Number: 5,502,988

[45] Date of Patent: Apr. 2, 1996

[54] INDUSTRIAL CLEANING APPARATUS

[75] Inventors: Masaru Shimazaki; Fumikata Maeda, both of Tokyo, Japan

[73] Assignee: Y.A.C. Corporation, Japan

[21] Appl. No.: 340,971

[22] Filed: Nov. 17, 1994

[30] Foreign Application Priority Data

Dec. 30, 1993 [JP] Japan ..... 5-352603

[51] Int. Cl.[6] ..... D06F 31/00; D06B 3/30

[52] U.S. Cl. ..... 68/3 R; 68/10; 68/27; 68/62; 68/175; 68/205 R

[58] Field of Search ..... 68/3 R, 9, 10, 68/27, 62, 175, 205 R; 134/73, 74, 83

[56] References Cited

U.S. PATENT DOCUMENTS 2,116,430 5/1938 Gordon ..... 134/83 X 3,686,899 8/1972 Rosenfeld et al. ..... 68/3 R 3,827,262 8/1974 Manuel ..... 68/3 R 4,300,366 11/1981 Barrett ..... 68/3 R

*Primary Examiner*—Philip R. Coe

*Attorney, Agent, or Firm*—Majestic, Parsons, Siebert & Hsue

[57] ABSTRACT

An industrial cleaning apparatus has a conveyor with a chain, the lower part of which extends horizontally to horizontally transport objects to be washed. Washing sections and have nozzles for blowing a cleanser or ozone water onto the object. A rinsing section contains a tank which is split into two parts when opened. These parts form a box-shaped container when closed. The rinsing section also includes a mechanism for opening and closing the tank and a supply device for supplying water or ozone water into the tank.

15 Claims, 6 Drawing Sheets

INDUSTRIAL CLEANING APPARATUS

BACKGROUND OF THE INVENTION

This invention relates to cleaning apparatus for industrial use.

There have generally been known the following two kinds of cleaning apparatus for industrial use adapted to wash target objects hung from hangers which are in turn suspended from a conveyor means, as disclosed, for example, in Japanese Patent Publication Tokkai 3-143930 (herein referred to as Prior Art Example One) and Japanese Patent Publication Tokkai 4-91480 (herein referred to as Prior Art Example Two). Prior Art Example One may be characterized as having suspending means attached to a chain of a conveyor means and using chuck means at lower ends of the suspending means to simultaneously deliver a plurality of target objects to rotary means for individual washing machines and to the conveyor means. Prior Art Example Two may be characterized as hanging target objects from hangers which are suspended at equal intervals from a chain of a conveyor means and causing the target objects to move upward and downward as the chain moves such that they can be immersed in a washing tank. Example One may appear to have high efficiency because a plurality of target objects are processed at once. In fact, however, a large number of target objects can be processed more efficiently by hanging them individually from the conveyor means according to Example Two because they are sequentially washed as they are transported rhythmically, or intermittently at a constant frequency. On the other hand, methods according to Example Two require target objects to be moved up and down in order to immerse them in water or ozone water inside a tank. The result of washing by this method is not always good because there are situations where a target object fails to be adequately immersed in the liquid in the tank. Additionally, apparatus according to Example Two tend to be large because they must include means for moving target objects up and down.

It is therefore an object of the present invention to provide cleaning apparatus for industrial use which are not only capable of cleaning a large number of target objects efficiently but also improving the quality of the cleaned objects.

It is another object to provide such apparatus which can be made compact.

SUMMARY OF THE INVENTION

An apparatus embodying the invention, with which the above and other objects can be achieved, comprises a conveyor means for suspending and transporting hangers from which target objects to be washed are hung, a washing section which is on the travel path of this conveyor means and a rinsing section where rinsing is carried out, and may be further characterized wherein the lower part of the chain of the conveyor means is horizontally oriented for transporting the target objects horizontally, the washing section includes projection nozzles for blowing a liquid cleanser or ozone water on the target objects, and the rinsing section includes a tank which can be opened and closed, being separated into two parts when opened and forming a box-like container for enclosing a target object when closed, a driving means for opening and closing this tank and a water supply means for supplying water or ozone water into the tank. As target objects are transported horizontally to the washing and rinsing sections, they are first washed in the washing section with water or ozone water blown from the nozzles. As they are transported to the rinsing section, the tank is closed and takes the form of a box to enclose the object therein, and water or ozone water is supplied into the tank by the water supplying means for rinsing. After the rinsing process, the tank is opened and the water or the ozone water inside the tank is discharged.

BRIEF DESCRIPTION OF THE DRAWINGS

The accompanying drawings, which are incorporated in and form a part of this specification, illustrate an embodiment of the invention and, together with the description, serve to explain the principles of the invention. In the drawings.

DETAILED DESCRIPTION OF THE INVENTION

Figure 1:
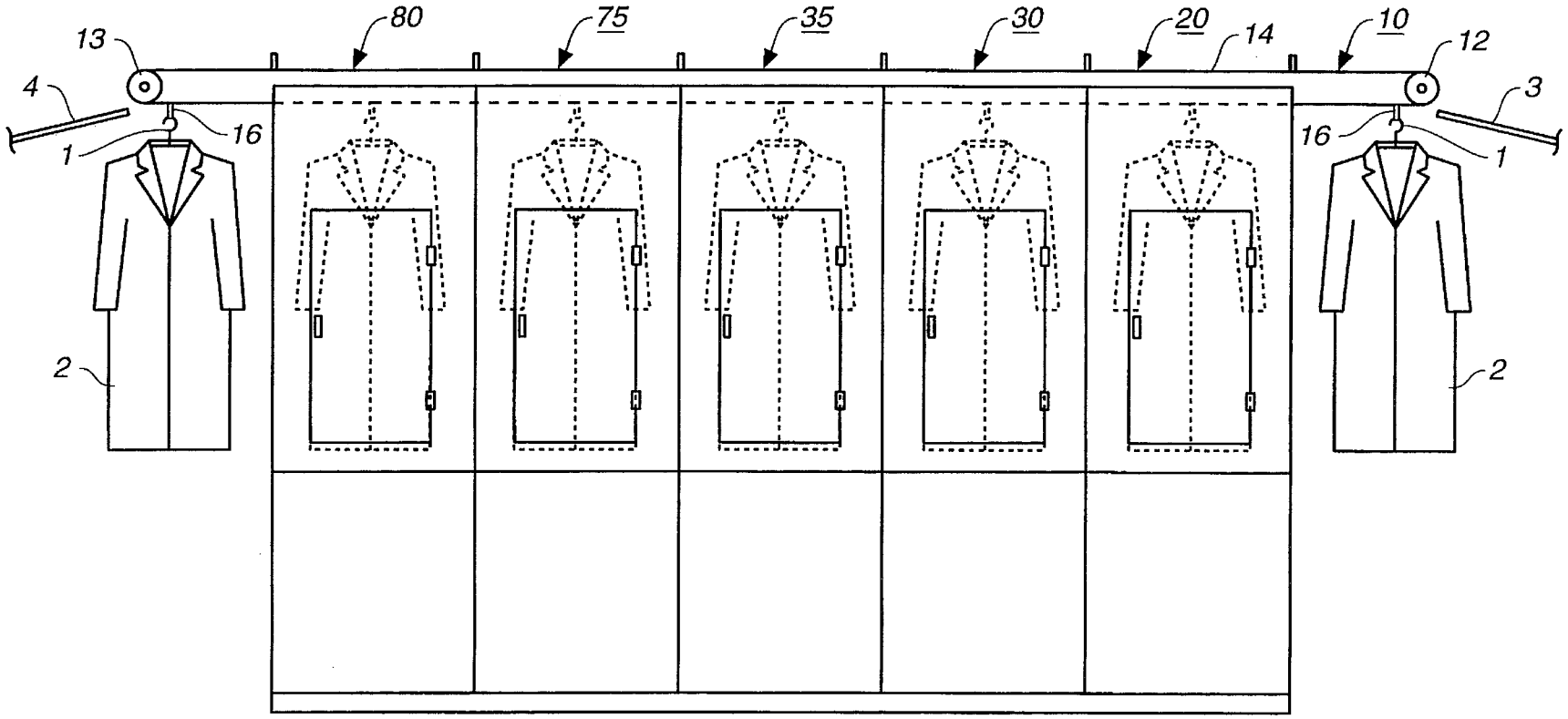
FIG. 1 is a front view of an industrial cleaning apparatus according to the invention.
Figure 2:
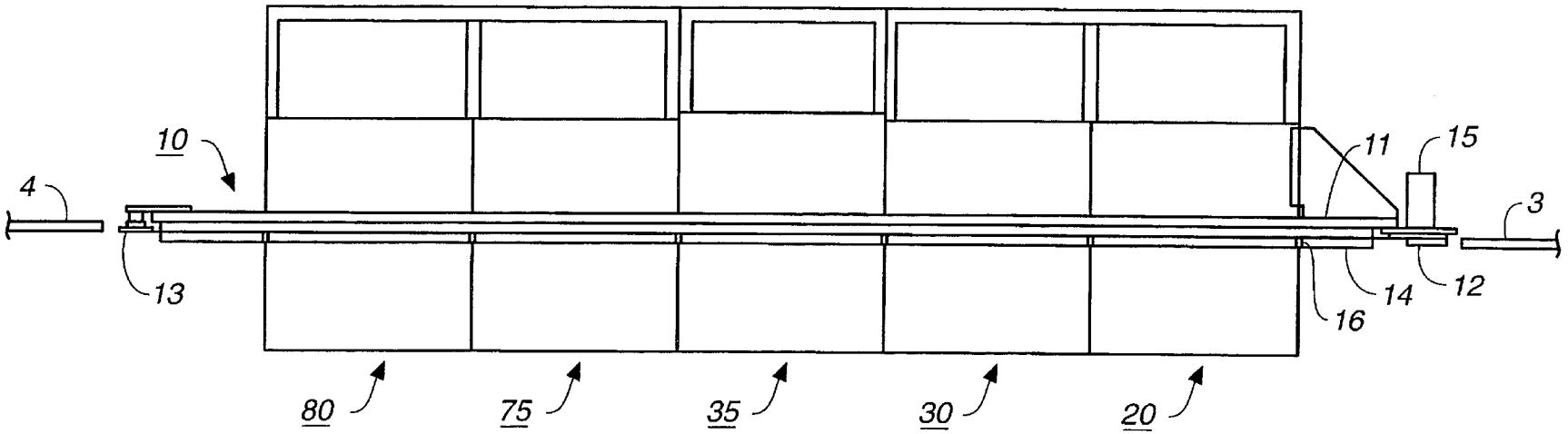
FIG. 2 is a plan view of the apparatus of FIG. 1.

An embodiment of this invention will be explained below with reference to FIGS. 1–10. As shown in FIGS. 1 and 2, objects 2 to be washed are individually hung from hangers 1, supplied to a conveyor means 10 of this invention through a supply conveyor 3 comprising a screw conveyor of a known kind, transported sequentially through a first washing section 20, a second washing section 30, a first rinsing section 35, a second rinsing section 75 and a final rinsing section 80, and then discharged to a discharge chute 4.

The conveyor means 10 is disposed at an elevated part of the apparatus, its support plate 11 rotatably supporting a driver sprocket 12 and a follower sprocket 13. An endless chain 14 is stretched between the driver and follower sprockets 12 and 13 such that the lower portion of the stretched chain 14 extends horizontally. The drive shaft of a motor 15 which is affixed to the support plate 11 is connected to the driver sprocket 12. Suspenders 16 for suspending the hangers 1, from which the objects 2 to be washed are hung at uniform intervals therefrom, are attached to the chain 14. Each suspender 16 is so attached to the chain 14 that the target objects 1 suspended therefrom through the hangers 1 will have their dimension of the width oriented in the direction of transportation by the chain 14 (with the dimension of the thickness transverse to the direction of transportation). The uniform intervals are selected to be slightly greater than the width of the targets objects 2 hung from the hangers 1.

Figure 4:
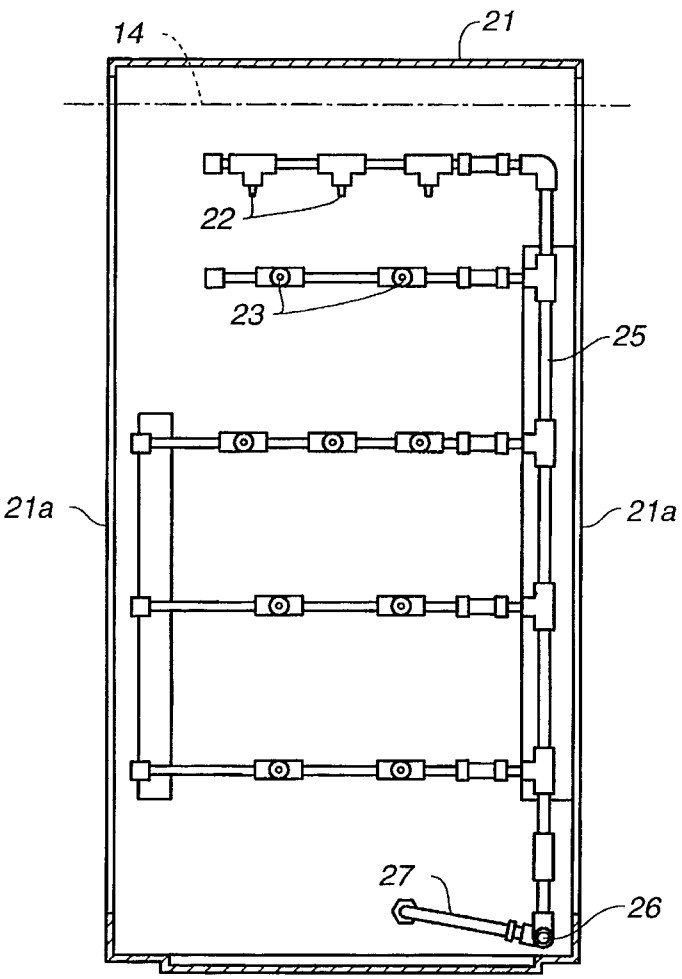
FIG. 4 is a sectional view taken along line 4—4 of FIG. 3.
Figure 3:
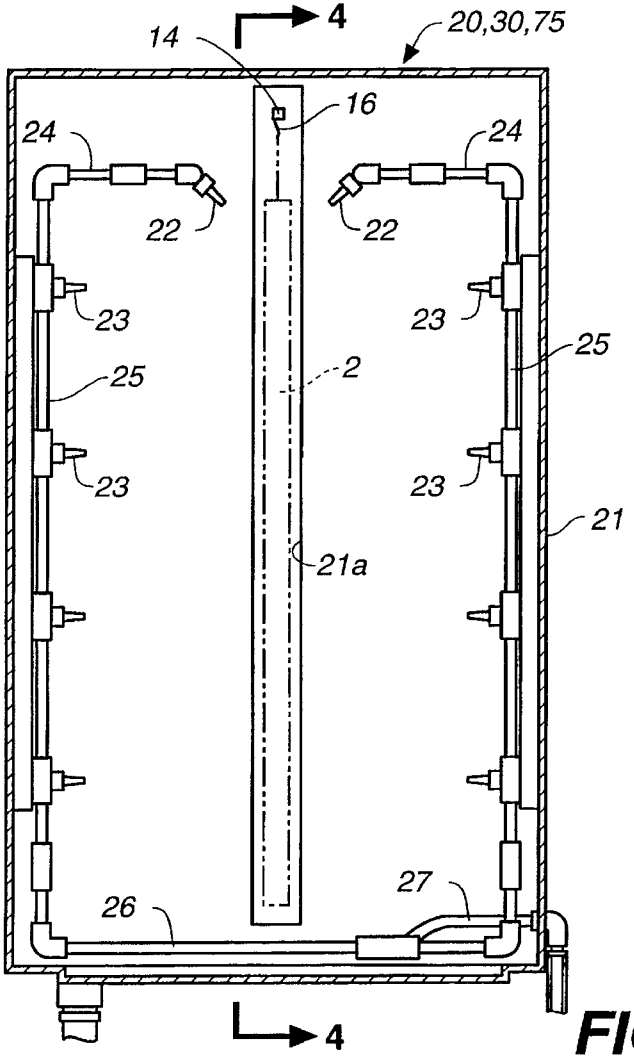
FIG. 3 is a sectional view of the first and second washing sections and the second rinsing section of the apparatus of FIGS. 1 and 2 taken in the direction of transportation of the objects to be washed.
Figure 6:
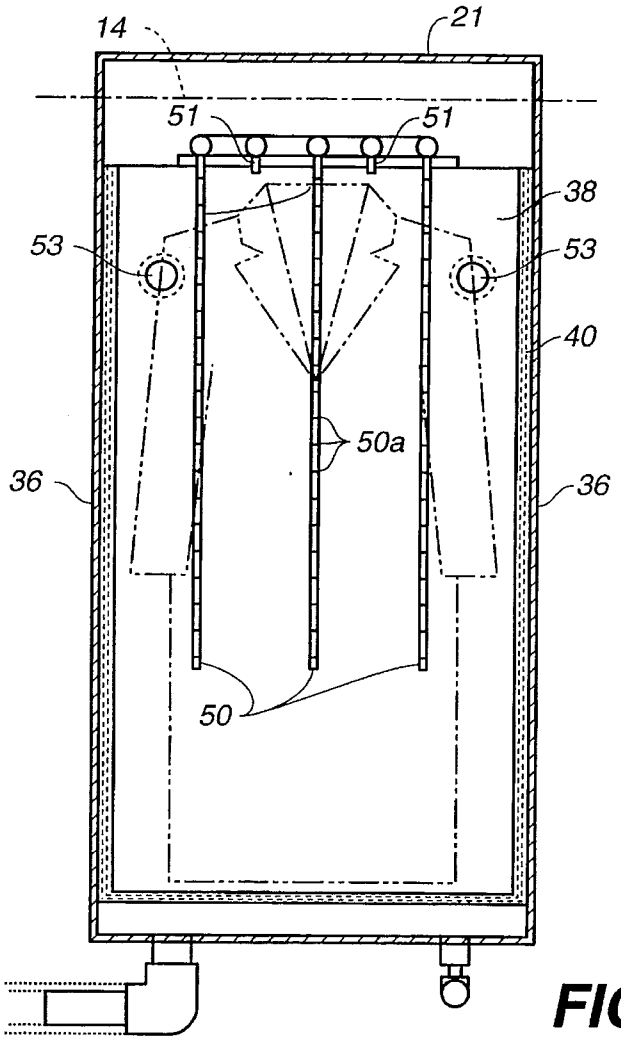
FIG. 6 is a side view of the first rinsing section of FIG. 5 taken from the left-hand side with respect to the direction of transportation.

The first washing section 20 is structured as shown in FIGS. 3 and 4 with passageways 21*a* provided under the chain 14 of the conveyor means 10 for passing targets objects 2 therethrough. On both side surfaces of the main housing 21, with respect to the direction of motion of the target objects 2, there are pairs of higher-positioned nozzles 22 opposite to each other and facing upper parts of a target object 2 and more pairs of nozzles 23 opposite to each other and to lower parts of the target object 2. As shown in FIG. 4, three pairs of higher-positioned nozzles 22 and nine pairs of lower-positioned nozzles 23 are provided altogether, and these nozzles 22 and 23 are connected through pipes 24, 25 and 26 to a supply pipe 27 through which a cleanser or zone water is supplied.

The second washing section 30 is structured identically to the first washing section 20, and hence its description will be omitted. A cleanser or ozone water is also supplied to the supply pipe 27 of the second washing section 30.

The first rinsing section 35 is structured as shown in FIGS. 5–8 with passageways 36 provided under the chain 14 of the conveyor means 10 for receiving and discharging target objects 2 therethrough. Inside the housing 21, there is a tank 37 surrounding the target object 2 and being adapted to be filled with water or ozone water. The tank 37 comprises a fixed part 38 disposed opposite to one side of the target object 2 and a mobile part 39 disposed opposite to the other side of the target object 2. The fixed part 38 makes up one half of the tank 37 which is open to the top, and the mobile part 39 makes up the other half of the tank 37 which is open both to the top and the bottom. Elastic members 40 and 41 (say, of rubber) are provided along the vertical side edges of the parts 38 and 39, and an openable bottom plate 43 having another elastic member 42 (say, of rubber) is provided at the opening portion at the bottom of the mobile part 39 such that this opening part can be tightly closed. The openable bottom plate 43 is rotatably supported by a support piece 44 attached to the outside of the mobile part 39 and is rotated by a cylinder 45 which is also attached to the support piece 44. In other words, a box-shaped container can be formed with the fixed and mobile parts 38 and 39 and the openable bottom plate 43.

There are three nozzle pipes 50 extending downward from the top along the inner surface of the fixed part 38 of the tank 37. Each nozzle pipe 50 is provided with many openings 50*a* which serve as nozzles. Additionally, there are liquid-emitting nozzles 51 above the fixed part 38 between the nozzle pipes 50. Both the nozzle pipes 50 and the nozzles 51 are connected to a supply pipe 52 into which water or ozone water is adapted to be supplied. Two other pipes 53 are connected to the fixed part 38 for supplying water or ozone water therethrough into the tank 37 when it is closed.

A back support plate 55 is attached to the outside surface of the mobile part 39 of the tank 37. Ends of a pair of link members 56 and 57 are rotatably attached to this back plate 55, and the other ends of the link members 56 and 57 are rotatably attached to members 58 and 59 which are affixed to the housing 21 of the apparatus. The link members 56 and 57 are attached to each other rotatably around a shaft 90 so as to together form a parallel linking mechanism. A tank-operating cylinder 91 is rotatably supported by the member 59 and the activating rod of the cylinder 91 is rotatably connected to the link member 56.

Inside the mobile part 39 of the tank 37, there are two pairs of rotary shafts 61 and 62 rotatably supported by bearings 60 attached to the part 39. In front of each pair of the rotary shafts 61 and 62, there are four contact plates 63 arranged vertically. (In other words, there are altogether eight such contact plates.) The top and bottom edges of each of these contact plates 63 are bent towards the mobile body part 39 to form bent portions 63*a* to which shafts 64 and 65 are attached. Levers 68 and 69, which are attached respectively to the shafts 61 and 62, are attached respectively to the shafts 64 and 65. Levers 68 and 69, which are attached to the top ends of the shafts 61 and 62, are rotatably connected to a connecting lever 71 through pins 70. A supporting plate 72 is attached to the external surface of the mobile body part 39 and rotatably supports a cylinder 73 with its activating rod connected rotatably to the lever 68.

The second rinsing section 75 is structured identically to the first washing section 20 shown in FIGS. 1 and 2, and hence its description will be omitted. Water or ozone water is adapted to be supplied to the supply pipe 27 of the second rinsing section 75.

Figure 10:
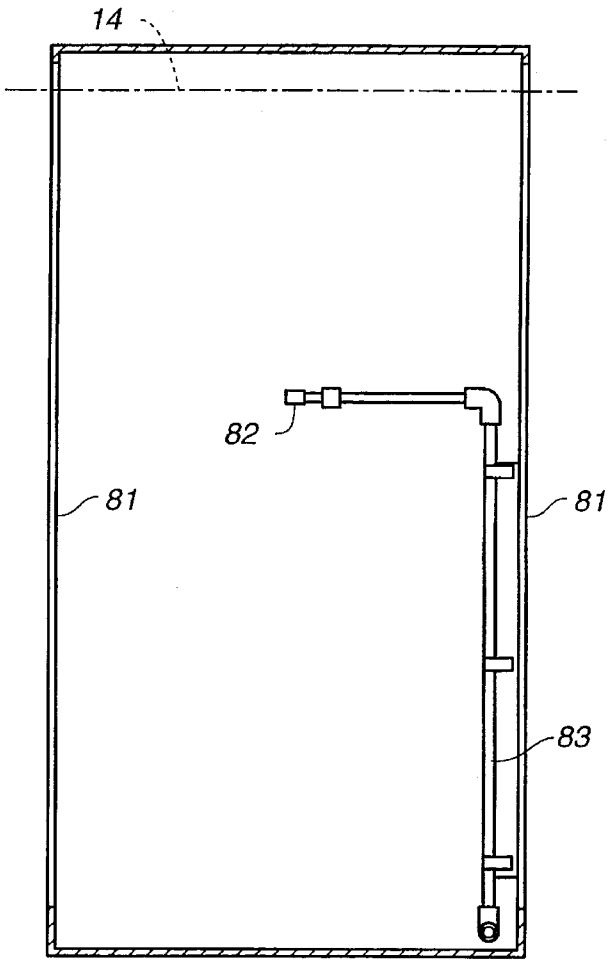
FIG. 10 is a sectional view of the final rinsing section taken along line 10—10 of FIG. 9.
Figure 9:
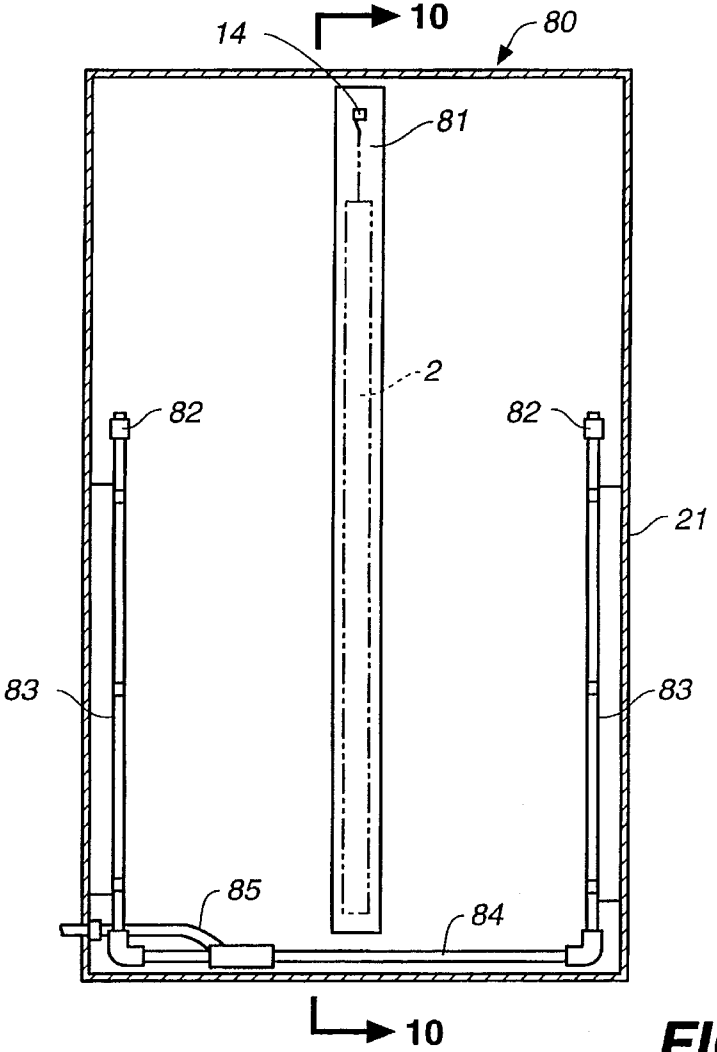
FIG. 9 is a sectional view of the final rinsing section taken in the direction of transportation of the objects to be washed.

The final rinsing section 80 is structured as shown in FIGS. 9 and 10 with passageways 81 provided under the chain 14 of the conveyor means 10 for receiving and discharging target objects 2 therethrough. Inside the housing 21, there is a pair of liquid-emitting nozzles 82 opposite to each other and facing opposite sides of a target object 2, connected through pipes 83 and 84 to a supply pipe 85 through which a rinse is supplied.

Next, the operation of the apparatus will be described. With reference first to FIGS. 1 and 2, the hangers 1, from which objects 2 to be washed are hung, are delivered from the supply conveyor 3 to the suspenders 16 of the conveyor means 10 while the chain 14 is in a stopped condition. The motor 15 is operated rhythmically, or intermittently at a constant frequency, such that the chain 14 will advance each time by a distance equal to the distance between each mutually adjacent pair of the suspenders 16 attached to the chain 14. In this mode of operation, each target object 2 is delivered sequentially to the first washing section 20, the second washing section 30, the first rinsing section 35, the second rising section 75 and the final rinsing section 80.

When one of the target objects 2 is transported into the first washing section 20 and stopped therein, a cleanser or ozone water is supplied to the pipe 27 shown in FIGS. 3 and 4 for a specified length of time and blown onto the object 2 through the nozzles 22 and 23. After the first washing process is thus completed, the object 2 is transported into the second washing section 30. Once the object 2 is thus positioned inside the second washing section 30, a cleanser or ozone water is supplied to the pipe 27 for a specified length of time, as done in the first washing section 20, to be blown onto the object 2 through the nozzles 22 and 23. Thus ends the main washing process.

Figure 5:
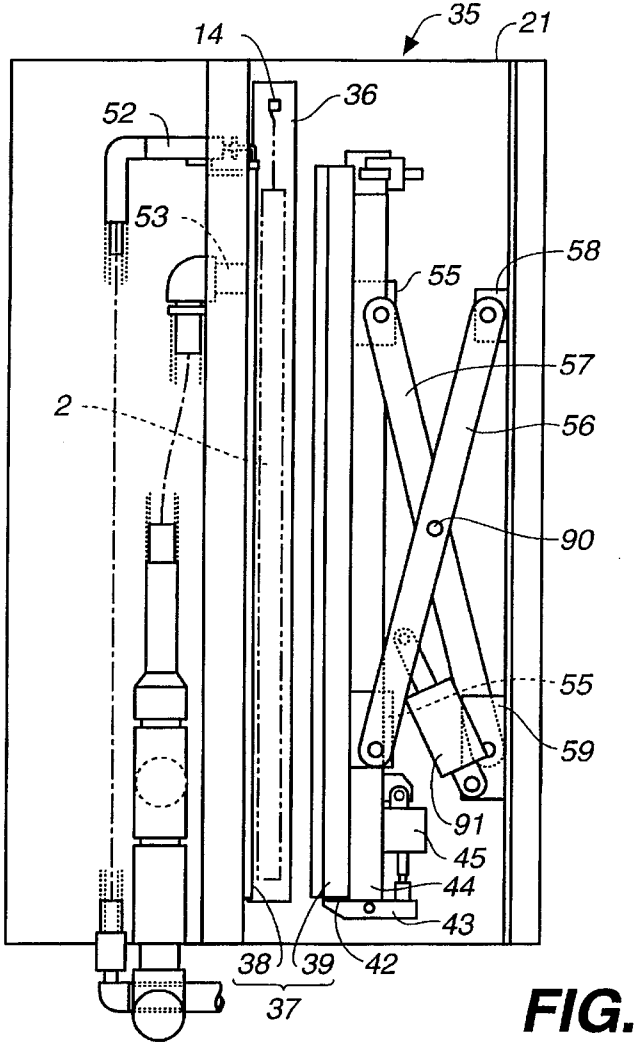
FIG. 5 is a sectional view of the first rinsing section taken in the direction of transportation of the objects to be washed.
Figure 8:
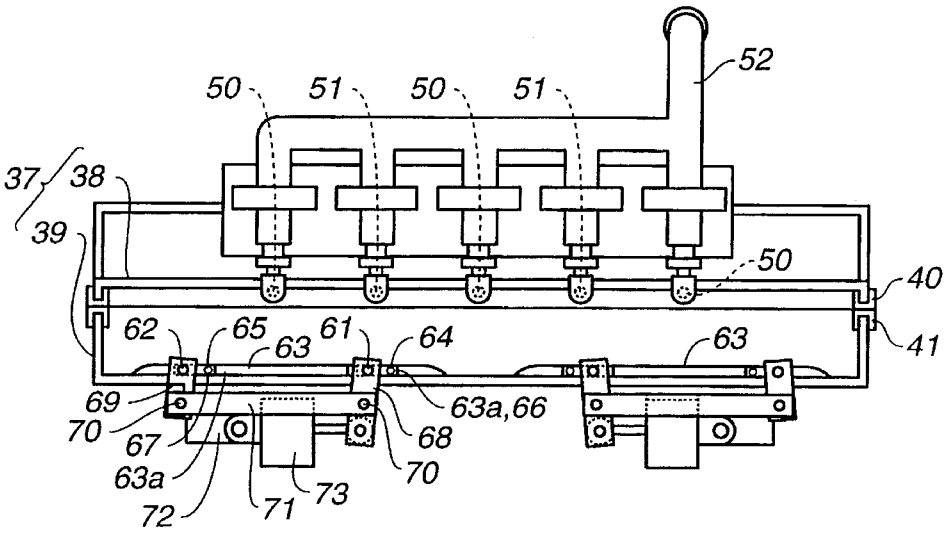
FIG. 8 is a plan view of the tank when then it is closed.
Figure 7:
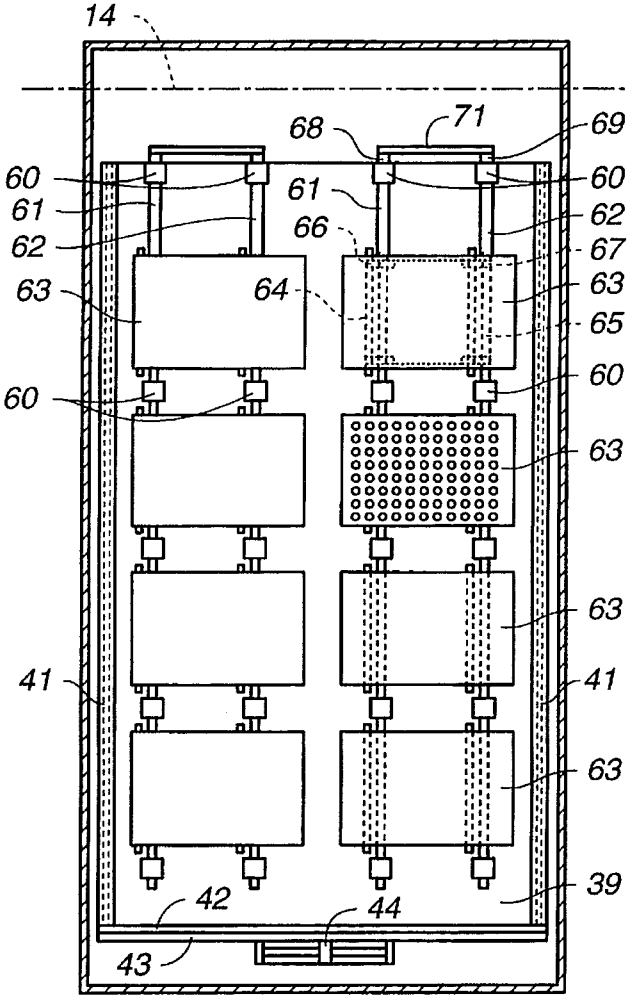
FIG. 7 is a side view of the first rinsing section of FIG. 5 taken from the right-hand side with respect to the direction of transportation.

After the second washing process, the target object 2 is transported into the first rinsing section 35. At this moment, while the chain 14 (and hence also the target object 2) is in motion, the mobile part 39 of the tank 37 is separated from the fixed part 38 as shown in FIG. 5. As the object 2 reaches the first rinsing section 35 and stopped, the tank-operating cylinder 91 is activated and its rod pushes forward to cause the mobile part 39 to approach the fixed part 38 until the elastic members 40 and 41 are pressed together as shown in FIG. 8. In this manner, the fixed and mobile parts 38 and 39, together with the openable bottom plate 43, form a box-shaped container serving as the tank 37 enveloping the target object.

Next, water or ozone water is supplied to the pipes 53 to fill the tank 37 therewith. Water or ozone water is also supplied to the supply pipe 52 to be blown onto the object 2 through the openings 50*a* and the liquid-emitting nozzles 51. The cylinder 73 is also activated such that its rod keeps moving forward and backward. With reference now to FIG. 8, if the activation rod of the cylinder 73 is pushed out, the levers 68 and 69 rotate in the counter-clockwise direction around the shafts 61 and 62. Since the rotary shafts 61 and 62 are affixed to the levers 68 and 69 and the levers 66 and 67 are affixed to the rotary shafts 61 and 62, the rotary shafts 61 and 62 also rotate when the levers 68 and 69 rotate such that the levers 66 and 67 rotate in the counter-clockwise direction around the shafts 61 and 62. As a result, the contact plates 63 advance forward while maintaining the same orientation. In the same way, the contact plates 63 move backward if the activation rod of the cylinder 73 is withdrawn.

Since water or ozone water is supplied into the tank 37 after the object 2 is introduced thereinto, the object 2 is reliably immersed in the water or ozone water. Since the contact plates 63 move backward and forward to stir the liquid and water or ozone is blown onto the object 2 through the openings 50*a* and the nozzles 51, the rinsing process is carried out even more effectively.

After a specified length of time, the supply of water or ozone water is stopped, and so is the operation of the cylinder 73. Next, the cylinder 45 is activated to withdraw its activation rod and to thereby open the bottom of the tank 37. The water or ozone water inside the tank 37 is thus drained downward.

Next, the tank-operating cylinder 91 is operated in the reverse direction and the mobile part 39 separates from the fixed part 38. Thereafter, the cylinder 45 operates also in the reverse way to close the bottom of the tank 37. Although the bottom of the mobile part 39 was made openable with the plate 43 according to the embodiment of the invention described above, the openable bottom plate 43 may be eliminated and a fixed bottom may be provided to the mobile part 39. If it is so structured, the water or ozone water inside the tank 37 will be drained all at once as the mobile part 39 is separated from the fixed part 38, and it will be necessary to provide an extra means for preventing the draining liquid from splashing to the surrounding areas. If the openable plate 43 is provided, as described above, the liquid is discharged only from the bottom and does not splash. It is not necessary that the entire section of the mobile part 39 be made openable. If the drain opening is made smaller, the load on the openable bottom plate 43 can be reduced accordingly.

After the first rinsing operation is completed, the target object 2 is transported into the second rinsing section 75 wherein water or ozone water is supplied to the pipe 27 shown in FIGS. 3 and 4 for a specified length of time to be blown onto the object 2 as the second rinsing process. After the second rinsing process, the object 2 is transported into the final rinsing section 80. After the object 2 is positioned inside the final rinsing section 80, a rinse is supplied to the pipe 85 shown in FIGS. 9 and 10 and blown onto the object through the nozzles 82. After the rinsing process is completed, the object 2 is discharged by the conveyor means 10 to the discharge chute 4 to be transported to an extractor for removing water still further from the processed object 2.

Although the first rinsing section 35 for rinsing by immersion and the second rinsing section 75 for rinsing by emission from nozzles were provided for the rinsing operation, the invention is not limited to this embodiment. It is acceptable, for example, to provide two rinsing sections both by immersion.

In summary, since the objects 2 suspended from the conveyor means 10 are individually and continuously processed and the work is completed while they are transported rhythmically, or intermittently at a constant frequency, a large number of target objects 2 can be cleaned extremely efficiently. Since the target objects 2 are transported horizontally by the conveyor means 10 to different processing sections, furthermore, the apparatus as a whole can be made compact. Since two parts 38 and 39 can together form a box-shaped tank 37 to contain the object 2 therein and then water or ozone water is supplied thereinto, the object 2 is reliably immersed in the liquid and the quality of washing is improved.

What is claimed is:

1. A cleaning apparatus for industrial use, comprising:

a conveyor means for transporting objects to be washed along a specified travel path; and washing sections and rinsing sections, disposed on said travel path, for washing and rinsing said objects;

said conveyor means including a chain having a horizontally extended portion for transporting said objects horizontally through said washing and rinsing sections;

said washing section containing nozzle means for emitting a cleanser or ozone water to said object; and said rinsing section including:

a tank which can be opened or closed, separating into two parts when opened and forming a box-shaped container when closed;

a driving means for opening and closing said tank; and a liquid supply means for supplying water or ozone water into said tank.

2. The cleaning apparatus of claim 1 wherein said rinsing section further includes:

nozzle means, provided to either of said parts of said tank, for blowing water or ozone water on said object; and contact plates, provided to the other of said parts of said tank, for moving backward and forward inside said tank.

3. The cleaning apparatus of claim 1 wherein said conveyor means include suspending means for suspending hangers from which said objects are hung.

4. The cleaning apparatus of claim 1 wherein said tank is separable into a fixed part and a mobile part on mutually opposite sides of said travel path, said tank further comprising elastic means attached to edges of said fixed and mobile parts for tightly closing said fixed and mobile parts together along said edges when said tank is closed.

5. The cleaning apparatus of claim 4 wherein said tank further comprises an openable bottom plate serving to automatically open and drain liquid content of said tank when said tank is opened.

6. The cleaning apparatus of claim 4 wherein said mobile part contains a stirrer for stirring a liquid inside said tank.

7. The cleaning apparatus of claim 6 wherein said stirrer includes:

vertically extended shafts;

a plurality of stirrer plates which are supported by said shafts vertically and parallel to said travel path; and means for rotating said shafts for horizontally moving said stirrer plates perpendicularly to said travel path.

8. The cleaning apparatus of claim 1 wherein said washing section contains nozzle means for emitting a cleaning liquid to said object.

9. The cleaning apparatus of claim 8 wherein said rinsing section further includes:

nozzle means, provided to either of said parts of said tank, for blowing a cleaning liquid on said object; and contact plates, provided to the other of said parts of said tank, for moving backward and forward inside said tank.

10. The cleaning apparatus of claim 8 wherein said tank is separable into a fixed part and a mobile part on mutually opposite sides of said travel path, said tank further comprising elastic means attached to edges of said fixed and mobile parts for tightly closing said fixed and mobile parts together along said edges when said tank is closed.

11. The cleaning apparatus of claim 10 wherein said mobile part contains a stirrer for stirring a liquid inside said tank.

12. The cleaning apparatus of claim 11 wherein said stirrer includes:

vertically extended shafts;

a plurality of stirrer plates which are supported by said shafts vertically and parallel to said travel path; and means for rotating said shafts for horizontally moving said stirrer plates perpendicularly to said travel path.

13. The cleaning apparatus of claim 1 wherein said tank is separable into a fixed part and a mobile part on mutually opposite sides of said travel path, said tank further comprising elastic means attached to edges of said fixed and mobile parts for tightly closing said fixed and mobile parts together along said edges when said tank is closed.

14. The cleaning apparatus of claim 13 wherein said mobile part contains a stirrer for stirring a liquid inside said tank.

15. The cleaning apparatus of claim 14 wherein said stirrer includes:

vertically extended shafts;

a plurality of stirrer plates which are supported by said shafts vertically and parallel to said travel path; and means for rotating said shafts for horizontally moving said stirrer plates perpendicularly to said travel path.

* * * * *